US011224982B2

(12) United States Patent
Efthimiadis et al.

(10) Patent No.: US 11,224,982 B2
(45) Date of Patent: Jan. 18, 2022

(54) RAZOR SYSTEM

(71) Applicant: Bic Violex S.A., Anixi (GR)

(72) Inventors: Dimitrios Efthimiadis, Athens (GR); Panagiotis Kopelas, Athens (GR)

(73) Assignee: Bic Violex S.A., Anoixi (GR)

( * ) Notice: Subject to any disclaimer, the term of this patent is extended or adjusted under 35 U.S.C. 154(b) by 0 days.

(21) Appl. No.: 16/309,949

(22) PCT Filed: Jun. 16, 2017

(86) PCT No.: PCT/EP2017/064847
§ 371 (c)(1),
(2) Date: Dec. 14, 2018

(87) PCT Pub. No.: WO2018/007133
PCT Pub. Date: Jan. 11, 2018

(65) Prior Publication Data

US 2019/0160698 A1 May 30, 2019

Related U.S. Application Data

(60) Provisional application No. 62/358,667, filed on Jul. 6, 2016.

(51) Int. Cl.
*B26B 21/22* (2006.01)
*B26B 21/40* (2006.01)
*B26B 21/56* (2006.01)

(52) U.S. Cl.
CPC ..... *B26B 21/227* (2013.01); *B26B 21/4012* (2013.01); *B26B 21/4031* (2013.01);
(Continued)

(58) Field of Classification Search
CPC ..... B26B 21/00; B26B 21/22; B26B 21/222; B26B 21/225; B26B 21/227; B26B 21/40;
(Continued)

(56) References Cited

U.S. PATENT DOCUMENTS 1,935,452 A * 11/1933 Kondolf ..... B26B 21/185 30/73
2,004,086 A * 6/1935 Testi ..... B26B 21/32 30/60.5

(Continued)

FOREIGN PATENT DOCUMENTS

CN 1496296 A 5/2004
CN 102216038 A 10/2011

(Continued)

OTHER PUBLICATIONS

International Search Report dated Oct. 9, 2017, in International Application No. PCT/EP2017/064847 (4 pages).

(Continued)

*Primary Examiner* — Sean M Michalski
*Assistant Examiner* — Richard D Crosby, Jr.
(74) *Attorney, Agent, or Firm* — Bookoff McAndrews, PLLC

(57) ABSTRACT

A shaving cartridge (1) with connectors (3) on each side portion of the plurality of side portions (2C) of the housing (2D) and a plurality of cutting members (7). Each of the connectors is operable to permit the side portions to pivot relative to each other. Thus, the housing will assume different configurations and is operable to adapt to and follow a contour defined by a shaving surface.

17 Claims, 3 Drawing Sheets

(52) U.S. Cl.
CPC ..... *B26B 21/4068* (2013.01); *B26B 21/56* (2013.01); *B26B 21/565* (2013.01)

(58) Field of Classification Search
CPC ..... B26B 21/4006; B26B 21/4012; B26B 21/4031; B26B 21/4068
See application file for complete search history.

(56) References Cited

U.S. PATENT DOCUMENTS 2,125,502 A * 8/1938 Holtzman ..... B26B 21/56 30/346.61
2,286,047 A * 6/1942 Young ..... B26B 21/56 30/346.59
2,409,604 A * 10/1946 Young ..... B21D 53/645 76/104.1
2,424,260 A 7/1947 Testi
3,593,416 A * 7/1971 Edson ..... B26B 21/14 30/50
4,993,154 A 2/1991 Radcliffe
5,661,907 A * 9/1997 Apprille, Jr. ..... B26B 21/225 30/47
6,145,201 A * 11/2000 Andrews ..... B26B 21/22 30/34.05
6,216,345 B1 * 4/2001 Andrews ..... B26B 21/22 30/34.05
6,493,950 B1 12/2002 Kludjian et al.
D556,378 S * 11/2007 Watson ..... D28/47
8,407,900 B2 * 4/2013 Johnson ..... B26B 21/4018 30/50
8,973,272 B2 * 3/2015 Moon ..... B26B 21/4068 30/50
9,999,980 B2 * 6/2018 Antoniou ..... B26B 21/443
2003/0204954 A1 * 11/2003 Wain ..... B26B 21/56 30/49
2004/0020053 A1 2/2004 Wain
2004/0168323 A1 * 9/2004 Lembke ..... B26B 21/227 30/50
2004/0261271 A1 * 12/2004 Coffin ..... B26B 21/227 30/50
2006/0080837 A1 * 4/2006 Johnson ..... B26B 21/44 30/50
2006/0080838 A1 * 4/2006 Johnson ..... B26B 21/225 30/50
2006/0236546 A1 10/2006 Johnson et al.
2007/0110703 A1 * 5/2007 O'Grady ..... B26B 21/44 424/73
2007/0209206 A1 9/2007 Van Eibergen Santhagens et al.
2008/0209734 A1 * 9/2008 Nicoll ..... B26B 21/44 30/41
2009/0193659 A1 8/2009 Park et al.
2010/0218381 A1 9/2010 Follo
2011/0308089 A1 12/2011 Bridges
2012/0030948 A1 2/2012 Walker, Jr. et al.
2012/0324737 A1 12/2012 Howell et al.
2014/0026424 A1 1/2014 Oglesby et al.
2014/0259675 A1 9/2014 Tucker et al.
2014/0259677 A1 9/2014 Coresh
2014/0373362 A1 12/2014 Bozikis
2015/0013169 A1 1/2015 Warrick
2015/0082638 A1 3/2015 Georgakis et al.
2015/0090085 A1 4/2015 Griffin et al.
2015/0101195 A1 4/2015 Long
2016/0089800 A1 3/2016 Coresh
2017/0266825 A1 9/2017 Bozikis et al.
2017/0282385 A1 10/2017 Bozikis et al.
2017/0341247 A1 * 11/2017 Zafiropoulos ..... B26B 21/565
2019/0224874 A1 * 7/2019 Blatter ..... B26B 21/225
2019/0283265 A1 * 9/2019 Efthimiadis ..... B26B 21/227

FOREIGN PATENT DOCUMENTS

CN 102947062 A 2/2013
EP 1 597 028 B1 6/2010
WO 2016102024 A1 6/2016

OTHER PUBLICATIONS

International Search Report in International Application No. PCT/EP2017/064848, dated Oct. 25, 2017 (5 pages).
Search Report issued in Chinese Patent Application No. 201780032397.4, dated Apr. 15, 2020 (2 pages).
Office Action issued in Chinese Patent Application No. 201780032397.4, dated Apr. 23, 2020 (9 pages).

* cited by examiner

Prior Art

RAZOR SYSTEM

CROSS-REFERENCE TO RELATED APPLICATIONS

This application is a National Stage application of International Application No. PCT/EP2017/064847, filed on Jun. 16, 2017, and published as WO2018/007133 on Jan. 11, 2018, which claims priority to U.S. Provisional Application No. 62/358,667, filed Jul. 6, 2016.

FIELD

The following disclosure relates to a shaving cartridge. More particularly, the disclosure relates to a shaving cartridge having a connector that allow the housing to assume a plurality of different configurations.

BACKGROUND

Along with the trend in recent years, many conventional shaving cartridge heads are equipped with movable blades. These conventional heads are rigid, but operable to permit a small degree of movement of the blades relative to the heads so that the blades can somewhat follow a skin contour to a small degree via an up or down vertical movement of the blades relative to the heads.

Conventional heads are associated with several drawbacks. For instance, the blades are only allowed to follow the skin contour towards a shaving motion direction as illustrated in FIG. 1A and FIG. 1B. Further, the blades are secured to the heads in a manner whereby a blade-to-skin angle is not constant and the angle cannot be self-adjusted as illustrated in FIG. 2A and FIG. 2B. These limitations are not advantageous in that they prevent a user from obtaining a close shave, i.e., an ideal shave whereby unwanted hairs are severed by the blades as close to the skin as possible without cutting the skin, and/or they may result in nicks and cuts to the skin of the user.

SUMMARY

Aspects of the disclosure may be related to a shaving cartridge. The shaving cartridge may include a housing. The housing may include a plurality of cutting members exposed via a top surface of the housing. The housing may include a plurality of elastic connections operable to secure the plurality of the cutting members within the housing. The housing may include a plurality of side portions on either side of the housing. The plurality of side portions may be rotatably secured together via connectors. An example of such connector may be a hinge. However, other types of connectors may be used as well. Thus, the shaving cartridge may be a hinged shaving cartridge.

Each of the connectors may be operable to permit the side portions to pivot relative to each other. Each of the connectors may be operable to allow the housing to assume a plurality of different configurations upon application of forces applied by the skin during the shaving process on the top surface of the housing and/or one or more of the plurality of blades. The plurality of configurations may include a convex, a concave and/or planar configuration. More specifically, the housing may assume the convex configuration when the shaving cartridge may encounter a recess in the skin of a user (a concave skin area). In other words, the forces acting from the concave skin area may be applied on the shaving cartridge causing the shaving cartridge to assume the convex configuration. The concave configuration of the shaving cartridge may be assumed when the shaving cartridge may encounter a protrusion on the skin of a user (a convex skin area). In other words, the forces acting from the convex skin area may be applied on the shaving cartridge causing the shaving cartridge to assume the concave configuration. The planar configuration of the shaving cartridge may be assumed when forces acting from a flat skin area (a planar skin area, no protrusions or recesses), may be applied on the shaving cartridge. According to another aspect, the disclosure includes a method of manufacturing a shaving cartridge.

The foregoing is intended to be illustrative and is not meant in a limiting sense. Many features of the embodiments may be employed with or without reference to other features of any of the embodiments. Additional aspects, advantages, and/or utilities of the present disclosure will be set forth in part in the description that follows and, in part, will be apparent from the description, or may be learned by practice of the present disclosure.

Effect

According to the present description, a shaving cartridge configured to follow a skin contour more closely, thus having an improved shaving performance, and a method of manufacturing the shaving cartridge are provided. More particularly, while shaving, the user applies an external force on his/her skin through a razor. The configuration of the shaving cartridge, its geometry and ability to rotate, allows the skin contour to be followed more closely and any excessive force applied by the user on his/her skin during the shaving is well distributed to a skin surface.

BRIEF DESCRIPTION OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the present disclosure is not limited to the precise embodiments and features shown. The accompanying drawings, which are incorporated in and constitute a part of this specification, illustrate an implementation of apparatuses consistent with the present disclosure and, together with the description, serve to explain advantages and principles consistent with the present disclosure.

DETAILED DESCRIPTION

Figure 1A:
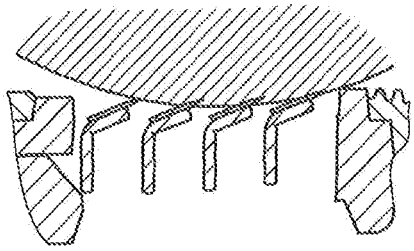
FIG. 1A is a partial cross-sectional view of a conventional head.
Figure 1B:
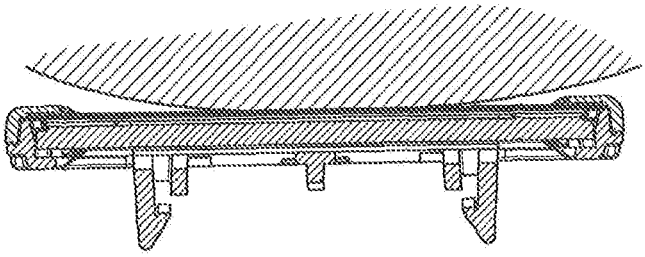
Prior Art FIG. 1B
FIG. 1B is a lateral view of the conventional head.
Figure 2A:
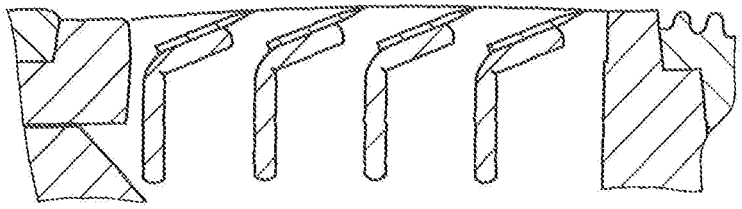
Prior Art FIG. 2A
FIG. 2A is a partial cross-sectional view of the conventional head with blades having different blade-to-skin angles that are not constant due to a concave contour of a shaving surface.
Figure 2B:
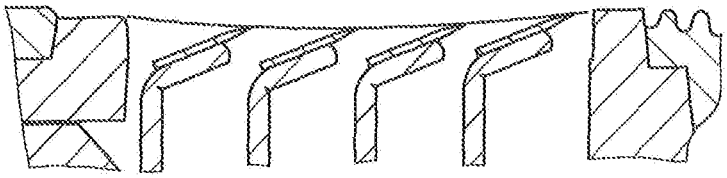
Prior Art FIG. 2B
FIG. 2B is a partial cross-sectional view of the conventional head with blades having different blade-to-skin angles that are not constant due to a convex contour of a shaving surface.

It is to be understood that the present disclosure is not limited in its application to the details of construction and to the embodiments of the components set forth in the following description or illustrated in the drawings. The figures and written description are provided to teach any person skilled in the art to make and use the concepts for which patent protection is sought. The present disclosure is capable of other embodiments and of being practiced and carried out in various ways. Persons of skill in the art will appreciate that the development of an actual commercial embodiment incorporating aspects of the present disclosure will require numerous implementations—specific decisions to achieve the ultimate goal of the developer for the commercial embodiment. While these efforts may be complex and time-consuming, these efforts nevertheless would be a routine undertaking for those of skill in the art of having the benefit of this disclosure.

I. Terminology

The phraseology and terminology employed herein are for the purpose of description and should not be regarded as limiting. For example, the use of a singular term, such as, "a" is not intended as limiting of the number of items. Also, the use of relational terms such as, but not limited to, "top," "bottom," "left," "right," "upper," "lower," "down," "up," "side," are used in the description for clarity in specific reference to the figures and are not intended to limit the scope of the present disclosure or the appended claims. Further, it should be understood that any one of the features of the present disclosure may be used separately or in combination with other features. Other systems, methods, features, and advantages of the present disclosure will be or become apparent to one with skill in the art upon examination of the figures and the detailed description. It is intended that all such additional systems, methods, features, and advantages be included within this description, be within the scope of the present disclosure, and be protected by the accompanying claims.

Further, any term of degree such as, but not limited to, "substantially," as used in the description and the appended claims, should be understood to include an exact or a comparable but not exact configuration. For example, "substantially" shaped means having an exact shape or a comparable but not exact shape. Likewise, "substantially L" shaped means having an exact "L" shape or a comparable but not exact "L" shape. Also, "a substantially planar surface" means having an exact planar surface or a comparable, but not exact planar surface. Similarly, the terms "about" or "approximately," as used in the description and the appended claims, should be understood to include the recited values or a value that is greater or less than the recited value by a percentage which is settable by the person skilled in the art in view of the context. For example, it would be a percentage of twenty percent greater or less than the recited values. For example, about 10 millimeters includes all values from 8 millimeter to 12 millimeters, and approximately 50 degrees includes all values from 40 degrees to 60 degrees.

Further, as the present disclosure is susceptible to embodiments of many different forms, it is intended that the present disclosure be considered as an example of the principles of the present disclosure and not intended to limit the present disclosure to the specific embodiments shown and described. Any one of the features of the present disclosure may be used separately or in combination with any other feature. References to terms "embodiment," "embodiments," and/or the like in the description mean that the feature and/or features being referred to are included in at least one aspect of the description. Separate references to terms "embodiment," "embodiments," and/or the like in the description do not necessarily refer to the same embodiment and are also not mutually exclusive unless so stated and/or except as will be readily apparent to those skilled in the art from the description. For example, a feature, structure, process, step, action, or the like described in one embodiment may also be included in other embodiments, but is not necessarily included.

Thus, the present disclosure may include a variety of combinations and/or integrations of the embodiments described herein. Additionally, all aspects of the present disclosure, as described herein, are not essential for its practice. Likewise, other systems, methods, features, and advantages of the present disclosure will be or become apparent to one with skill in the art upon examination of the figures and the description. It is intended that all such additional systems, methods, features, and advantages be included within this description, be within the scope of the present disclosure, and be encompassed by the claims.

Lastly, the terms "or" and "and/or," as used herein, are to be interpreted as inclusive or meaning any one or any combination. Therefore, "A, B or C" or "A, B and/or C" mean "any of the following: A, B, C; A and B; A and C; B and C; A, B and C." An exception to this definition will occur only when a combination of elements, functions, steps or acts are in some way inherently mutually exclusive.

II. General Architecture of the Shaving Cartridge

Figure 3A:
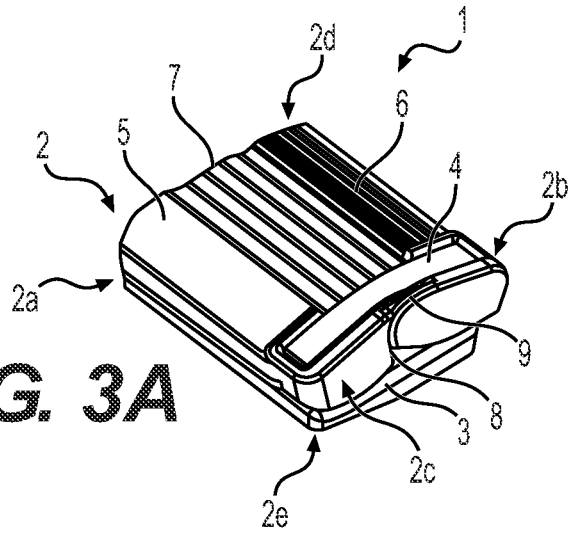
FIG. 3A is a partial perspective view of a shaving cartridge of the present disclosure with elastic connections and in a convex configuration.
Figure 3B:
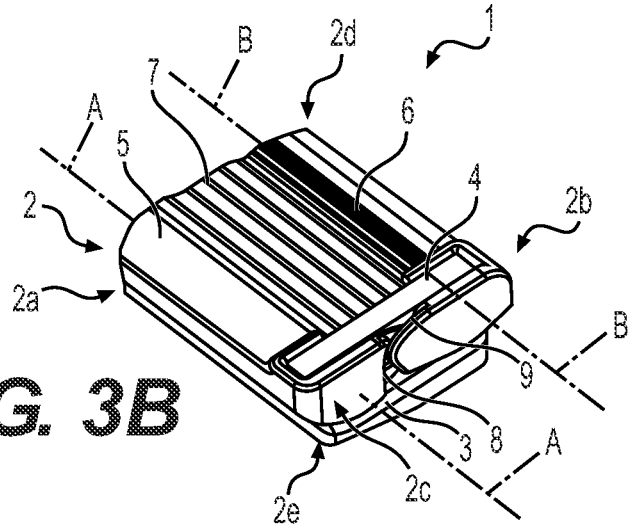
FIG. 3B is a partial perspective view of a shaving cartridge of the present disclosure with elastic connections and in a planar configuration.
Figure 3C:
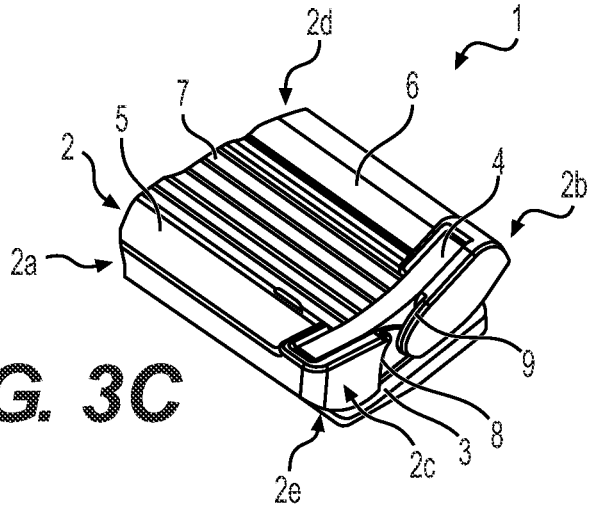
FIG. 3C is a partial perspective view of a shaving cartridge of the present disclosure with elastic connections and in a concave configuration.

Turning to FIGS. 3A-3C, according to aspects of the disclosure, a shaving cartridge 1 may include a housing 2 having a front portion 2*a* and a rear portion 2*b* opposing the front portion 2*a*. said the housing may also include a plurality of side portions 2*c*. Further, the housing 2 may include a top portion 2*d*, and a bottom portion 2*e*. The plurality of side portions 2*c* may extend between the front portion of the housing 2*a* and the rear portion of the housing 2*b*. The plurality of side portions 2*c* may include a front abutment 8 and a rear abutment 9. The shaving cartridge 1 may include a guard bar 5 adjacent to the front portion 2*a* of the housing 2 and a cap 6 adjacent to the rear portion 2*b* of the housing 2. The housing 2 may include at least one cutting member 7. The at least one cutting member 7 may be at least one blade 7. The at least one blade 7 may be arranged between the front portion 2*a* of the housing 2 and the rear portion 2*b* of the housing 2. According to some aspects, the at least one blade 7 may be positioned between the guard bar 5 and the cap 6. The at least one cutting member 7 may be arranged such that is the at least one cutting member 7 may be exposed via the top portion 2*d* of the housing 2. The top portion 2*d* of the housing 2 may be a top surface of the housing. The at least one cutting member 7 may be supported by elastic arms. The elastic arms may extend towards each other and may extend upwardly from the plurality of side portions 2*c* of the housing 2. The elastic arms may be configured to elastically bias the cutting member 7 toward a position where the at least one cutting member 7 may be in contact with a plurality of elastic connections 4. The plurality of elastic connections 4 may be attached to the housing 2 on each side of the at least one cutting member 7 such that the plurality of elastic connections 4 may extend entirely across the at least one cutting member 7. The at least one cutting member 7 may include a cutting edge. The cutting edge may be exposed via a top portion 2*d* of the housing 2.

Each one of the plurality of side portions 2*c* may include a connector 3 that may rotatably secure a front portion 2*a* and a rear portion 2*b* together so that each of the plurality of side portions 2*c* may be operable to pivot relative to each other, as illustrated by FIGS. 3A-3C. By "pivot", it is understood that the axis of rotation of the front portion 2*a* with respect to the rear portion 2*b* may be fixed, or may move if; in addition to the rotation, the side portions 2*c* may be guided in translation with respect to one another. Such connector 3 may be a hinge or a living hinge. The connector 3 may also have the shape of a rivet or a pin and a respective recess, allowing the front portion 2*a* to rotate relative to the rear portion 2*b*. Each of the connectors 3 defines an axis that allows the guard bar 5 to rotate in either direction thereabout as the shaving cartridge 1 travels along contours, e.g., convex and/or concave contours, of a shaving surface.

Each of the plurality of elastic connections 4 may be resilient, thereby (i) allowing each of the plurality of side portions 2*c* to pivot as illustrated by FIGS. 3A and 3C, (ii) defining maximum degrees of pivot of the plurality of side portions 2, and (iii) biasing the plurality of side portions 2*c* to a parallel configuration whereby the top portion of the housing 2*d* may have a substantially planar surface, as illustrated by FIG. 3B. The maximum degrees of pivot of the plurality of side portions 2*c* may be also defined by the front abutment 8 and the rear abutment 9. As such, the housing 2 may be assuming the convex configuration or the concave configuration, the front abutment 8 and the rear abutment 9 may come into contact. At this stage, the maximum degrees of pivot may be achieved and no further deflection of the housing 2 may be allowed. Each of the plurality of elastic connections 4 may define two axes, an axis AA and an axis BB, spaced equidistant from a center on either side thereof. As shown on FIG. 3B, the axis AA may be located on the front portion of the housing 2*a* where the guard bar 5 may be present and the axis BB may be located on the rear portion of the housing 2*b* where the cap 6 may be present.

Figure 5:
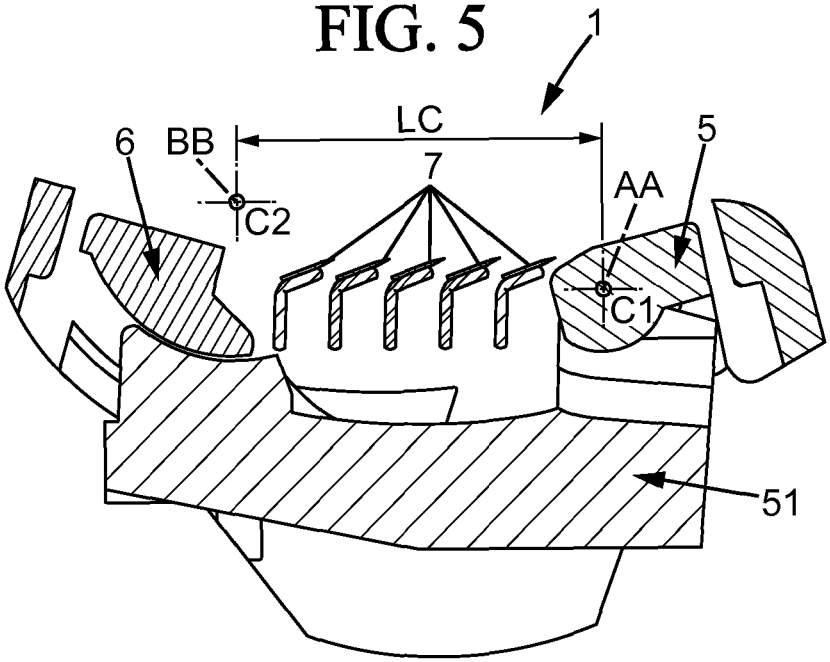
FIG. 5 is a cross sectional view of the shaving cartridge of the present disclosure in the concave configuration, showing an axis AA and axis BB.

The axis AA and the axis BB of the plurality of elastic connections 4 may be (i) about 0.7 mm and 1.5 mm, and according to some aspects, may be about 1 millimeter above and/or below the shaving plane defined by the shaving surface depending on a configuration of the shaving cartridge 1, as illustrated on FIGS. 3A and 3C; and may be (ii) spaced about 6.0 mm 10.0 mm, and according to further aspects, may be about 8.0 millimeters from each other, projected at the shaving plane at the rest position, as illustrated on FIG. 3B. Similar to a hinge axis, the two axes of the plurality of elastic connections 4 may allow the guard bar 5 to rotate around the axis AA and the cap 6 to rotate around the axis BB as the shaving cartridge 1 may be allowed to travel along contours, e.g., convex and/or concave contours, of the shaving surface. According to some aspects, the axis AA may be spaced about 1.5 mm and 2.0 mm and according to further aspects, about 1.80 millimeters from the cutting edge of a closest or most-adjacent one of the plurality of cutting members. As shown on figure FIG. 5, a center C1 of the axis AA and the center C2 of the axis BB may be fixed points defined by the guard 51. The front portion 2*a* may be mounted to pivot with respect to the guard about the fixed axis AA of the guard. The rear portion 2*b* may be guided to pivot with respect to the guard about the fixed axis BB of the guard. A distance LC between these two centers of the axes may remain the same/constant in each configuration of the shaving cartridge 1 (concave, convex or planar configuration). More precisely, the distance LC may remain constant, independent from the forces may act from the shaving surface onto the shaving cartridge 1 and may cause the head to assume the convex configuration, the concave configuration, or the planar configuration. The distance LC may be between 6.5 mm to 10.0 mm.

In use, the shaving cartridge 1 may be operable to adapt to, i.e., change shape to follow, the shaving surface, e.g., skin of the user, thereby providing a close shave to the user and an improved shaving experience relative to conventional shaving heads. The close shave provided may allow the user to sever unwanted hair closer to the skin relative to conventional shaving heads and avoid unwanted nicks and cuts, especially in difficult-to-shave spots, e.g., around a chin of the user or behind a knee of the user, etc.

Figure 4A:
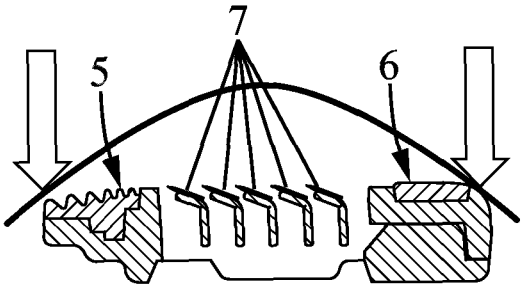
FIG. 4A is a graphical representation of where the skin first meets the shaving cartridge in concave skin contours superimposed in an existing MvB head.
Figure 4B:
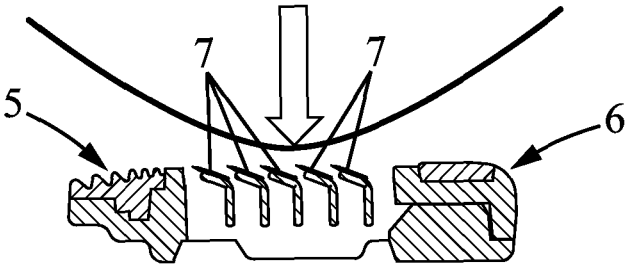
FIG. 4B is a graphical representation of where the skin first meets the shaving cartridge in convex skin contours superimposed in an existing MvB head.

For instance, as detailed in FIGS. 4A and 4B, the shaving cartridge 1 may be operable to interact with the skin of the user. More particularly, as illustrated in FIG. 4A, the shaving cartridge 1 may encounter a recess in the skin, i.e., the concave skin area, the connectors 3 may be operable to pivot so that the guard bar 5 and the cap 6 make contact or touch the skin first (see FIG. 4A), which may cause the housing 2 to assume the convex configuration. According to some aspects, the concave skin area may indicate a skin area/shaving surface that may be curved inward. In this manner, nicks, cuts, or an "attack" on the skin may avoided during use of the shaving cartridge 1 and the improved shaving is achieved. Likewise, the shaving cartridge 1 may encounter a protrusion on the skin, i.e., the convex skin area, the connectors 3 may be operable to pivot so that the housing 2 may assume the concave configuration (see FIG. 4B). In other words, the forces acting from the convex skin area during the shaving may be applied on the shaving cartridge causing the shaving cartridge to assume the concave configuration. According to other aspects, the convex skin area may indicate a skin area/shaving surface that may bulge outward. In this manner, the present disclosure provides a smoother cutting edge contact, thereby providing a close shave without any additional effort from the user. According to further aspects, the shaving cartridge 1 may encounter flat/planar skin, and the forces acting from the flat skin may causing the shaving cartridge 1 to assume the planar configuration. A flat/planar skin may indicate a skin area/shaving surface where no protrusions/recess are present.

It will be appreciated by those skilled in the art that changes could be made to the embodiments described above without departing from the broad disclosure thereof. It is understood, therefore, that the present disclosure disclosed herein is not limited to the particular embodiments disclosed, and is intended to cover modifications within the spirit and scope of the present disclosure.

One of skill in the art will recognize that the described examples are not limited to any particular size. Further, one of skill in the art will recognize that the components of the shaving cartridge are not limited to any type of material. In a preferred example, the housing is formed of a polymer, but may be formed of a variety of different materials including one or more metal materials or the like, or a combination thereof. One skilled in the art will recognize that different diameters, types, and thicknesses of preferred materials can be utilized when taking into consideration design and stability considerations. A number of manufacturing techniques may be used such as the machining, molding, or casting one or more components of the retainer. An example process of manufacturing the housing may include the use of an injection-molding machine or other like manufacturing means.

It will be appreciated by those skilled in the art that changes could be made to the embodiments described above without departing from the broad disclosure thereof. It is understood, therefore, that the present disclosure is not limited to the particular embodiments disclosed, and is intended to cover modifications within the spirit and scope.

III. Method of Manufacturing a Shaving Cartridge

According to a further aspect, a method of manufacturing the shaving cartridge 1 may include at least a step of forming a housing 2 having a front portion 2*a* and a rear portion 2*b*, each one of said portions having a plurality of side portions 2*c*, and a top portion 2*d*; connecting the plurality of side portions 2*c* rotatably together via connectors 3; mounting at least one cutting member 7 within the housing 2. The connectors 3 may be a hinge and said at least one cutting member 7 may be at least one blade. The cutting member 7 may include a cutting edge exposed via the top portion of the housing 2*d*. The connectors 3 may allow the side portions of the housing 2*c* to pivot relative to each other. Further the method may include a step of securing a plurality of elastic connections 4 to the housing 2. The elastic connections 4 may be operable to secure at least one cutting member 7 within the housing 2.

The invention claimed is:

1. A shaving cartridge comprising:

a housing having at least one cutting member exposed via a top portion of the housing, a plurality of elastic connections configured to secure the at least one cutting member within the housing, and a plurality of side portions rotatably connected together via connectors;

the plurality of elastic connections being positioned at opposing ends of the at least one cutting member and being configured to span the connectors rotatably joining the plurality of side portions;

each of the connectors being operable to permit the plurality of side portions to rotate relative to each other so that the housing is operable to assume a plurality of configurations.

2. The shaving cartridge according to claim 1, wherein the connectors comprise a hinge.

3. The shaving cartridge according to claim 1, wherein each of the plurality of elastic connections defines a first axis on a front portion and a second axis on a rear portion.

4. The shaving cartridge according to claim 3, wherein the first axis includes a center and the second axis includes a center, the center of the first axis and the center of the second axis defining a distance therebetween, the distance between the first axis and the second axis being constant upon the operable relative rotation of the plurality of side portions.

5. The shaving cartridge according to claim 4, wherein the housing includes a first portion having a guard and second portion having a cap, the guard being allowed to rotate about the first axis and the cap being allowed to rotate about the second axis.

6. The shaving cartridge according to claim 5, wherein the guard defines a shaving plane, the first axis and the second axis being 0.7 mm to 1.5 mm above or below the shaving plane.

7. The shaving cartridge according to claim 3, wherein the housing includes a first portion having a guard and second portion having a cap, the guard being allowed to rotate about the first axis and the cap being allowed to rotate about the second axis.

8. The shaving cartridge according to claim 3, wherein the distance between the first axis and the second axis is 1.5 mm to 2.0 mm.

9. The shaving cartridge according to claim 3, wherein the first axis and the second axis are spaced 6.0 mm to 10.0 mm from one another.

10. The shaving cartridge according to claim 1, wherein the housing is configured to assume the plurality of configurations consisting of a convex configuration; a concave configuration; and a planar configuration.

11. The shaving cartridge according to claim 10, wherein the convex configuration of the housing is assumed upon a force acting from a concave skin area being applied on the top portion of the housing.

12. The shaving cartridge according to claim 10, wherein the concave configuration of the housing is assumed upon a force acting from a convex skin area being applied on the top portion of the housing.

13. The shaving cartridge according to claim 10, wherein the housing is biased toward the planar configuration.

14. The shaving cartridge of claim 1, wherein the at least one cutting member includes a plurality of cutting members, and each of the plurality of elastic connections extends over each of the plurality of cutting members.

15. A method of manufacturing the shaving cartridge according to claim 1, the method comprising the steps of:

providing the plurality of side portions;

rotatably connecting the plurality of side portions together via the connectors, thereby making the housing having the top portion;

mounting the at least one cutting member within the housing; and securing the plurality of elastic connections to the housing, the plurality of elastic connections being operable to secure the at least one cutting member within the housing and to permit the side portions to pivot, so the housing is operable to assume the plurality of configurations.

16. A method of manufacturing a shaving cartridge including the steps of:

providing a plurality of side portions;

rotatably connecting the plurality of side portions together via connectors, thereby assembling a shaving cartridge housing having a top portion;

mounting at least one cutting member within the housing, the at least one cutting member being exposed via the top portion of the housing; and securing a plurality of elastic connections to the housing, the plurality of elastic connections being operable to secure at least one cutting member within the housing and to permit the side portions to pivot, so the housing is operable to assume a plurality of configurations.

17. The method of manufacturing of a shaving cartridge according to claim 16, wherein each of the plurality of side portions is a hinge.

* * * * *